United States Patent [19]

Mizell

[11] 4,379,703

[45] Apr. 12, 1983

[54] APPARATUS FOR SECURING FINS TO A SURFBOARD

[75] Inventor: James A. Mizell, Huntington Beach, Calif.

[73] Assignee: California Fin Systems, Huntington Beach, Calif.

[21] Appl. No.: 260,488

[22] Filed: May 4, 1981

[51] Int. Cl.[3] ..... A63C 15/05

[52] U.S. Cl. ..... 441/79

[58] Field of Search ..... 441/79; 403/362, 381; 114/126, 127, 140, 141

[56] References Cited

U.S. PATENT DOCUMENTS

| | | | |
|---|---|---|---|
| 2,302,181 | 11/1942 | Bruce | 403/381 |
| 3,422,471 | 4/1967 | Morey et al. | 441/79 |
| 4,320,546 | 3/1982 | Knox | 441/79 |

FOREIGN PATENT DOCUMENTS

| | | | |
|---|---|---|---|
| 491811 | 3/1977 | Australia | 441/79 |

*Primary Examiner*—Trygve M. Blix
*Assistant Examiner*—Thomas J. Brahan
*Attorney, Agent, or Firm*—Fischer, Tachner & Strauss

[57] ABSTRACT

An apparatus for securing a fin to the bottom surface of a surfboard and comprising a uniquely configured fin box designed to provide a more secure structural relationship between the fin box and the surfboard. The invention is also designed to provide a more secure means for securing the fin within the fin box to prevent inadvertent loss of the fin while still providing a more advantageous means for releasing the fin from the fin box when removal of the fin is desirable. More specifically, the present invention comprises a fin box of substantially rectangular configuration and designed to be embedded within the underlying surface of the surfboard whereby the exterior surface of the fin box lies flush with the exterior underlying surface of the surfboard. A novel flange integral with the fin box is included to provide added structural resistance to transverse forces that normally occur during surfing which would otherwise tend to cause rotation and loosening of the fin box within the surfboard. In addition, the fin box of the present invention provides an angularly oriented securing means at one end of the fin which permits reliable but readily removable means for securing the fin within the fin box.

3 Claims, 4 Drawing Figures

APPARATUS FOR SECURING FINS TO A SURFBOARD

FIELD OF THE INVENTION

The present invention relates to surfboards and more specifically to an improved apparatus for securing a surfboard fin to the underlying surface of the surfboard.

PRIOR ART

The concept of using a fin box for releasably securing a fin to the underside surface of a surfboard is old in the art. For example, the G & S Star Systems Company is currently manufacturing a substantially rectangular fin box that includes a pair of transversely oriented fixed pins at the opposing locations within said fin box for locking a fin within the box after the box has been permanently secured within and flush with the surface of the surfboard. However, such prior art suffers from a number of disadvantages which are overcome in the present invention. More specifically, the extreme lateral forces to which the fin is subjected during surfing and which forces are transmitted to the fin box relative to the surfboard, tend to subject the fin box to rotation about an axis parallel to the longitudinal axis of the surfboard and eventually cause loosening of the fin box which could cause loss of the fin and the box within which it is contained. In addition, because the prior art device provides for a snap-in fin arrangement utilizing the aforementioned pins, the fin is difficult to install and tends to be either extremely difficult to remove or too easily removable to the extent that the fin may fall out of the fin box during use of the surfboard and result in permanent loss of the fin.

When the fin interconnection to the fin box is too tight and thus causes great difficulty in removal of the fin, a safety hazard to the user results because of the tendency to attempt to apply substantial manual force to the sharp end of the fin which could result in lacerations of the hand. Thus the prior art most relevant to the present invention is unreliable from the standpoint of a high probability of inadvertent loss of the fin box/fin combination, the fin itself and on some occassions, use of the prior art device may result in severe injury to the user when a fin proves difficult to remove from the fin box. These problems result primarily from the two deficiencies in the prior art, namely, a fin box geometry that does not provide sufficient resistence to lateral forces and a fin box which does not provide a reliable and consistent fastening means with a repeatable degree of retention that provides for secure but readily removable fin.

SUMMARY OF THE INVENTION

The present invention overcomes the aforementioned disadvantages of the prior art by providing an improved fin box of substantially rectangular configuration but having an integral rectangular flange extending perpendicularly from the fin and adapted to lie within a matching enlarged aperture within the surfboard to provide substantially increased resistance to lateral forces that might otherwise disengage the fin box from the surfboard and result in the loss of the fin and fin box. Furthermore, the present invention provides a more positive securing means for the fin itself comprising a diagonally or angularly configured aperture for receiving a fastening device which replaces at least one of the laterally disposed pins of the prior art whereby a threaded screw may be used to positively secure the fin with sufficient retention within the box while still permitting ready removal of the fin only when it is desired.

OBJECTS

It is therefore a primary object of the present invention to provide a fin box for securing a fin to the underlying surface of a surfboard and which substantially overcomes the aforementioned disadvantages of the prior art.

It is a further object of the present invention to provide a surfboard fin/fin box combination which is substantially more resistant to inadvertent loss of the fin and fin box than the prior art and which permits ready and safe removal of the fin from the fin box only when desirable.

It is still a further object of the present invention to provide a unique fin/fin box combination which is far more resistant to lateral forces normally incurred during surfing and which would otherwise tend to loosen the fin box with respect to the surfboard and thus increase the chances of loss of the fin box; and which is also configured to permit easy installation and removal of the fin with respect to the fin box with a consistent and reliable degree of retention force without inadvertent loss of the fin.

It is still a further object of the present invention to provide a surfboard fin/fin box combination which utilizes a unique means for fastening the fin within the fin box whereby removal of the fin can be readily accomplished without requiring the user to apply manual force against the sharp edge of the fin that would otherwise create a high likelihood of injury.

BRIEF DESCRIPTION OF THE DRAWINGS

The above-indicated objects and advantages of the present invention, as well as additional objects and advantages thereof, will be more fully understood hereinafter as a result of the detailed description of a preferred embodiment of the invention taken in conjunction with the accompanying drawings in which.

DETAILED DESCRIPTION OF A PREFERRED EMBODIMENT

Figure 1:
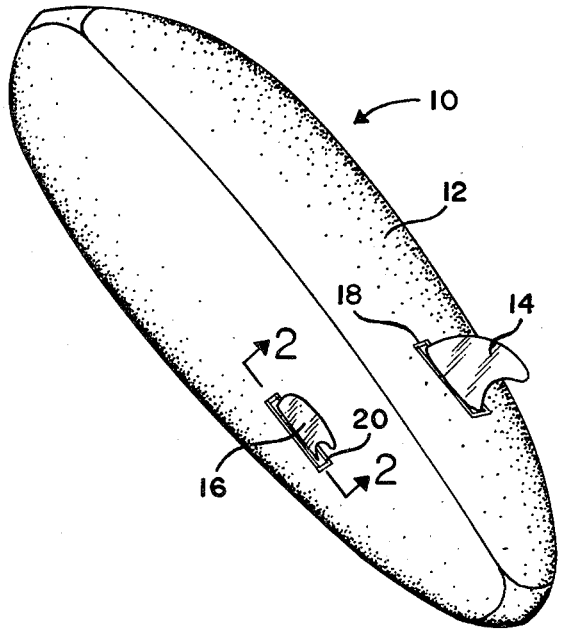
FIG. 1 is a three dimensional view of a surfboard including the underlying surface thereof illustrating typical fin installations for which the present invention may be used.
Figure 3:
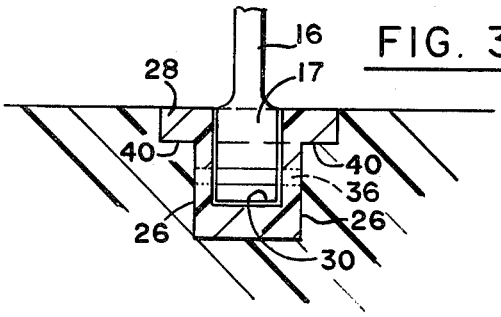
FIG. 3 is a partial sectional end view of a fin/fin box combination of the invention taken along lines 3—3 of FIG. 2.
Figure 4:
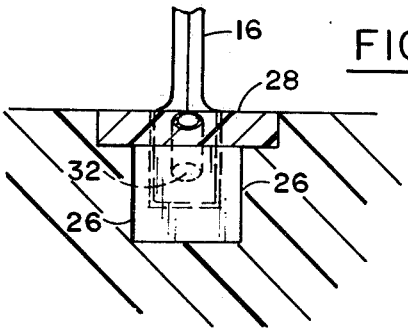
FIG. 4 is a partial sectional end view of a fin/fin box combination of the invention taken along lines 4—4 of FIG. 2.

Referring now to FIG. 1 there is shown a typical surfboard 10 viewed from the water side surface 12 thereof and having, by way of example, two fins 14 and 16 which are installed in surfboard 10 by means of connection within permanently affixed fin boxes 18 and 20. More specifically, as shown in greater detail in FIGS. 2, 3 and 4, a fin such as fin 16 which includes a base 17, is removably installed within a fin box 20. Fin box 20 which comprises a floor member 22, a pair of end members 24, a pair of side members 26 and a flange member 28. Members 22, 24, 26 nd 28 are interconnected to form an open-type box arrangement having a cutaway portion therein illustrated in the drawings as a rectangular elongated channel or slot 30. Fin base 17 and slot 30 are of dimensions selected to make them compatible whereby base 17 of fin 16 is seated within slot 30 in a secure fashion after being fastened therein as will be more fully explained hereinafter.

It will be understood that flange 28, which in the embodiment illustrated in the accompanying figures completely surrounds the entrance to slot 30, provides added resistance to the lateral forces normally applied to the fins during surfing and transmitted to the fin boxes into which the fins are inserted. Thus prior art which provides a fin box not including such a flange is far more likely to loosen within the surfboard surface 12 and thus create a high probability of loss of the fin and fin box. On the other hand, the present invention is far more resistant to such loosening because of the flange in that flange 28 provides increased surface area for secured contact between the outside surface of fin box 20 and surfboard 10. In addition, flange 28 provides resistance to rotational forces to which the box is subjected in two distinct planes, namely, one plane perpendicular to the general plane of the surfboard 10 as in the prior art, but also in another plane generally parallel to the plane of the surfboard as a result of the horizontal underlying surface of flange 28 which bears against a corresponding horizontal surface routed into the surfboard as indicated generally by the horizontal interface 40 along the bottom edge of flange 28.

A substantial additional advantage of the present invention as compared to the prior art resides in the manner in which the fin is secured within the fin box. More specifically, the prior art device utilizes a pair of horizontal grooves at the opposing shorter ends of the fin base and a corresponding pair of nylon pins extending transversely through the slot 30 and the elongated sides of the fin box. In the present invention a diagonal aperture 32 having a threaded stainless steel insert 34 therein is used to provide a more positive controllable means for securing one side of the fin within the fin box. There is a corresponding receiving notch 35 along the short edge of the fin base adjacent aperture 32 within the slot 30 to receive a fastening means such as a nylon screw having threads matched to the stainless steel insert 34. The other end of fin base 17 may be secured in the more conventional manner utilizing a horizontal groove 36 and a fixed nylon pin 38 which extends transversely through the elongated side members 26 of fin box 20 as seen best in FIGS. 2 and 3. It should be noted that only because of the addition of novel flange 28 is it now possible to conveniently provide a diagonal aperture 32.

Figure 2:
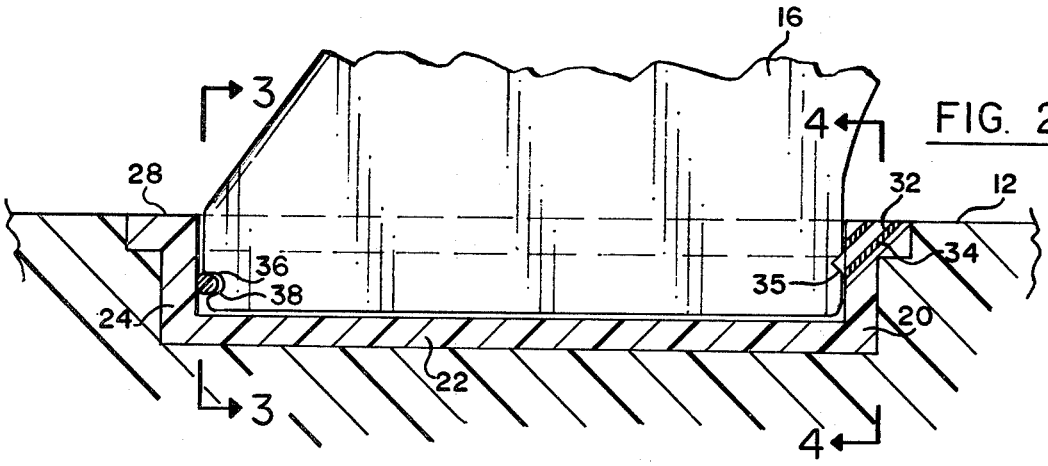
FIG. 2 is a partial sectional side view of a fin/fin box combination of the invention taken along lines 2—2 of FIG. 1.

The means by which a fin 16 may be installed in positive locking engagement within fin box 20 will now be clear to those having skill in the art to which the present invention pertains. More specifically, it will be clear that the base 17 of fin 16 is first inserted within slot 30 of fin box 20 in a slightly angled configuration whereby groove 36 of base 17 is caused to engage pin 38 as seen in FIG. 2. The fin may then be rotated clockwise as seen in FIG. 2 until the fin base rests on the inside surface of floor member 22. Then a screw made of nylon or other suitable material and having threads matched to the threaded stainless steel insert 34, may be tightened within aperture 32 until the forward or pointed end of such a screw comes in contact with the fin surface at notch 35 along base 17. It will thus be clear that with rotational engagement of the fin with respect to pin 38 and positive fixed engagement of a fastening means such as a nylon screw secured within stainless steel insert 34 and engaging notch 35 of base 17, fin 16 is positively secured within fin box 20. However, fin 16 can be readily removed by merely rotating it out of the slot around pin 38 after the screw into notch 35 is removed from diagonal aperture 32 and stainless steel insert 34 sufficiently to disengage from the notch 35.

Although the materials and dimensions of the novel fin box and fin of the present invention may be varied in accordance with surfboard design in the preferred embodiment illustrated herein, fins 14 and 16 are made of glass-filled ABS resin, ABS being a common abbreviation for acrylonitrile-butadienestyrene copolymer. The fin box is also made of ABS resin. Typical dimensions for the fin box provide for a slot length of 6 inches, a slot width of $\frac{3}{8}$ inches and a slot depth of $\frac{7}{8}$ inches. Flange 28 typically extends $\frac{1}{2}$ inch from slot 30 and is approximately 5/16 inch in width. End members 24, side members 26, and floor member 22 are typically $\frac{1}{8}$ inch thick. The fin box height, measured from the top of flange 28 to the bottom surface of floor member 22, is typically 15/16 inch.

It will now be understood that what has been described herein is a novel fin box and matching fin base for a surfboard which provides certain improvements over prior art fin box/fin configurations. More specifically, in the present invention a unique flange and fin securing means are provided to prevent inadvertent loss of the fin and fin box during surfing while still providing means for readily removing the fin from the fin box when desired without requiring application of manual force to the sharp edge of the fin which might otherwise result in injury to the user. It will be further understood that although a preferred embodiment of the invention has been disclosed herein, the invention is not to be limited to that particular embodiment as many variations may be made to the invention by way of different geometries and materials without departing from the scope of the invention which is limited only by the claims appended hereto:

I claim:

1. An improved device for being integrated into the water-side surface of a surfboard for receiving a removable surfboard fin, the device of the type comprising a unitary, substantially rectangular elongated member having a substantially rectangular elongated cut-away portion extending through one surface thereof and having means within the cut-away portion for retaining the base of the surfboard fin, the remainder of the fin extending from said one surface; the improvement comprising:

a flange integral to said member and extending along at least a portion of said one surface of said cut-away portion for bearing against said surfboard in two planes, one such plane being parallel to said water-side surface and one such plane being perpendicular to said water-side surface, in response to lateral forces applied to said fin during surfing, a pin extending through the elongated walls of said member and through said cut-away portion in a direction perpendicular to the longer surfaces of said member and in proximity to a shorter surface of said member.

said pin being adapted to receive a grooved portion of said fin base for relative rotational engagement therewith, a substantially cylindrical aperture extending diagonally through said member from the external surface thereof and extending through said flange and into said cut-away portion at a location therein substantially opposite said pin, and fastening means extending through said sperture and being adapted to engage a notched portion of said fin base for securing said fin within said device.

2. The improvement recited in claim 1 further comprising:

a surfboard fin having a substantially rectangular elongated base of dimensions substantially equal to said cut-away portion of said device, said base being grooved at substantially one end of the elongated dimension thereof for rotatably engaging said pin and being notched at substantially the other end of the elongated dimension thereof for engaging said fastening means.

3. A unitary fin box for a surfboard of the type that employs at least one removable fin on the water-side surface thereof, the fin box comprising:

an open elongated box-like member having a floor member, a pair of opposing shorter end members, a pair of opposing longer side members, said floor, end members and side members interconnected to form an elongated slot for receiving the base portion of said removable fin, said fin box also having a flange member extending substantially parallel to said floor member along the entrance to said slot, and at least one aperture extending diagonally into said slot extending through one of said end members and through said flange member and toward said floor member for receiving fastening means for securing said base portion within said slot.

* * * * *